US010137557B2

(12) United States Patent
Suryavanshi et al.

(10) Patent No.: US 10,137,557 B2
(45) Date of Patent: Nov. 27, 2018

(54) HIGH-DENSITY POLYCRYSTALLINE DIAMOND

(71) Applicant: DIAMOND INNOVATIONS, INC., Worthington, OH (US)

(72) Inventors: Abhijit Prabhakar Suryavanshi, Issaquah, WA (US); Suresh S. Vagarali, Columbus, OH (US)

(73) Assignee: Diamond Innovations, Inc., Worthington, OH (US)

( * ) Notice: Subject to any disclaimer, the term of this patent is extended or adjusted under 35 U.S.C. 154(b) by 0 days.

(21) Appl. No.: 15/355,316

(22) Filed: Nov. 18, 2016

(65) Prior Publication Data

US 2017/0136605 A1 May 18, 2017

Related U.S. Application Data

(60) Provisional application No. 62/256,757, filed on Nov. 18, 2015.

(51) Int. Cl.
*E21B 10/567* (2006.01)
*B24D 18/00* (2006.01)

(52) U.S. Cl.
CPC ..... *B24D 18/0009* (2013.01); *E21B 10/567* (2013.01)

(58) Field of Classification Search
CPC ..... E21B 10/567; B24D 18/0009
See application file for complete search history.

(56) References Cited

U.S. PATENT DOCUMENTS 3,141,746 A 7/1964 Lai
3,399,254 A 8/1968 Dunnington
3,574,580 A 4/1971 Stromberg et al.
3,609,818 A 10/1971 Wentorf
3,745,623 A 7/1973 Rocco
3,829,544 A 8/1974 Hall
3,850,591 A 11/1974 Wentorf
4,394,170 A 7/1983 Akira
4,403,015 A 9/1983 Tetsuo
4,794,326 A 12/1988 Friedl
4,954,139 A 9/1990 Cerutti
6,860,914 B2 3/2005 Davies et al.
7,470,341 B2 12/2008 Keshavan et al.
8,316,969 B1 11/2012 Bertagnolli et al.
2005/0019114 A1 1/2005 Sung
2006/0266558 A1* 11/2006 Middlemiss ..... B22F 7/062 175/426
2010/0242375 A1 9/2010 Hall et al.
2013/0086847 A1* 4/2013 DiGiovanni ..... B29C 67/04 51/307
2013/0264124 A1 10/2013 Belnap
2013/0291443 A1 11/2013 Naidoo et al.
2014/0013672 A1 1/2014 Malik et al.

OTHER PUBLICATIONS

Weidner et al: "Strength of Diamond". Sciene, New Series, vol. 266, No. 5184 (Oct. 21, 1994), pp. 419-422.

* cited by examiner

*Primary Examiner* — Pegah Parvini

(57) ABSTRACT

A superabrasive compact and a method of making the superabrasive compact are disclosed. A method of making a superabrasive compact includes the steps of providing a plurality of superabrasive particles; subjecting the plurality of superabrasive particles to conditions of a first elevated temperature and pressure; and crushing the plurality of superabrasive particles into a pill under the first elevated high pressure and high temperature.

26 Claims, 2 Drawing Sheets

HIGH-DENSITY POLYCRYSTALLINE DIAMOND

TECHNICAL FIELD AND INDUSTRIAL APPLICABILITY

The present disclosure relates generally to superabrasive compact, such as polycrystalline diamond or cubic boron nitride and a method of making such superabrasive compact, and more particularly to dense packing such superabrasive particles for cutters.

SUMMARY

In one embodiment, a method of making a superabrasive compact, representing a superabrasive body bonded to a substrate, may include steps of providing a plurality of superabrasive particles; subjecting the plurality of superabrasive particles to conditions of a first elevated temperature and pressure; pressing the plurality of superabrasive particles into a pill under the first elevated temperature and pressure; providing a substrate attached to the pill; and subjecting the substrate and the pill to conditions of a second elevated temperature and pressure suitable for producing the superabrasive compact.

In another embodiment, a method of making a superabrasive compact includes steps of providing a plurality of superabrasive particles; subjecting the plurality of superabrasive particles to conditions of a first elevated temperature and pressure; and crushing the plurality of superabrasive particles into a pill under the first elevated high pressure and high temperature.

In yet another embodiment, a superabrasive compact prepared by a process including steps of: providing a plurality of superabrasive particles; subjecting the plurality of superabrasive particles to conditions of a first elevated temperature and pressure, wherein the plurality of superabrasive particles do not have a catalyst present during the first elevated temperature and pressure; and crushing the plurality of superabrasive particles into a pill under the first elevated high pressure and high temperature.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWING

The accompanying drawings, which are included to provide a further understanding of the embodiments of disclosure and are incorporated in and constitute a part of this specification, illustrate embodiments of the invention and together with the description serve to explain the principles of the invention. In the drawings.

DETAILED DESCRIPTION

Figure 1:
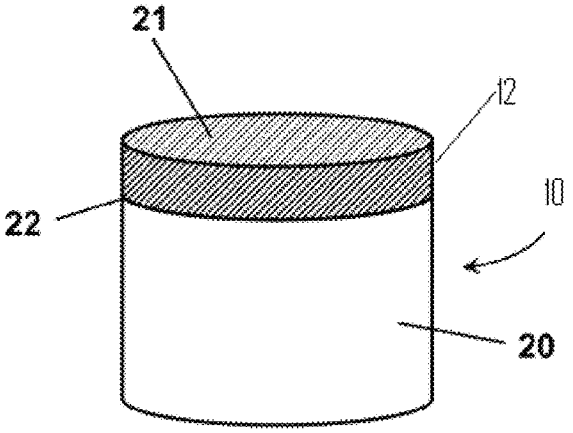
FIG. 1 is a perspective view of a superabrasive compact according to an embodiment.

Before the description of the embodiment, terminology, methodology, systems, and materials are described; it is to be understood that this disclosure is not limited to the particular terminologies, methodologies, systems, and materials described, as these may vary. It is also to be understood that the terminology used in the description is for the purpose of describing the particular versions of embodiments only, and is not intended to limit the scope of embodiments. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Unless otherwise indicated, all numbers expressing quantities of ingredients or properties, such as size, weight, reaction conditions and so, forth used in the specification and claims are to the understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the numerical value of the number with which it is being used. Therefore, about 50% means in the range of 40%-60%.

As used herein, the term "superabrasive particles" may refer to ultra-hard particles or superabrasive particles having a Knoop hardness of 3500 KHN or greater. The superabrasive particles may include diamond and cubic boron nitride, for example. The term "abrasive", as used herein, refers to any material used to wear away softer materials.

The term "particle" or "particles", as used herein, refers to a discrete body or bodies. A particle is also considered a crystal or a grain.

The term "superabrasive compact", as used herein, refers to a sintered product made using super abrasive particles, such as diamond feed or cubic boron nitride particles. The compact may include a support, such as a tungsten carbide support, or may not include a support. The "superabrasive compact" is a broad term, which may include cutting element, cutters, or polycrystalline diamond or cubic boron nitride insert.

The term "cutting element", as used herein, means and includes any element of an earth-boring tool that is used to cut or otherwise disintegrate earth formation material when the earth-boring tool is used to form or enlarge a bore in the formation.

The term "feed" or "diamond feed", as used herein, refers to any type of diamond particles, or diamond powder, used as a starting material in further synthesis of PDC cutters.

The term "superabrasives", as used herein, refers to abrasives possessing superior hardness and abrasion resistance. Diamond and cubic boron nitride are examples of superabrasives and have Knoop indentation hardness values of over 3500.

The terms "diamond particle" or "particles" or "diamond powder", which is a plurality of single crystals or polycrystalline diamond particles, are used synonymously in the instant application and have the same meaning as "particle" defined above.

Polycrystalline diamond compact ("POD", as used hereinafter) or composite may represent a volume of crystalline diamond grains with embedded foreign material filling the inter-grain space. In one particular case, a PCD composite comprises crystalline diamond grains, bound to each other by strong diamond-to-diamond bonds and form a rigid polycrystalline diamond body. The inter-grain regions, disposed between the bounded grains may be filled in one part with a catalyst material (e.g. cobalt or its alloys), which was used to promote diamond-to-diamond bonding during fabrication, and other part filled in other materials which may remain after the sintering of diamond compact. Suitable metal solvent catalysts may include the iron group transitional metal in Group VIII of the Periodic table.

In another particular case, PCD composite comprises a plurality of crystalline diamond grains, which are not bound to each other, but instead are bound together by foreign binding material such as carbides, borides, nitrides, and others, e.g. by silicon carbide. PCD cutting element comprises a body of above mentioned polycrystalline diamond composite attached to a suitable substrate, e.g. cobalt cemented tungsten carbide (WC—Co). The feature enables PCD composite materials to be used in the form of wear or cutting element that may be attached to wear and/or cutting, such as subterranean drill bits, by conventional attachment means, such as by brazing and the like.

"Thermally stable material", as is understood commonly, refers to a material able to withstand the cutting conditions resulting in a high temperature of the cutting edge, thus resulting in a lower cutter wear. "Thermally stable polycrystalline diamond," as used herein, refers to a PCD being able to withstand the cutting conditions resulting in a high temperature of the cutting edge, thus resulting in a lower cutter wear.

The presence of catalyst binder material inside the polycrystalline diamond body promotes the degradation of the cutting edge of the compact, especially if the edge temperature reaches a high enough critical value. It is theorized that the cobalt (or other transition metal catalyst) driven degradation may be caused by the large difference in coefficient of thermal expansion between diamond and catalyst, and also by the catalytic effect of cobalt on diamond graphitization. Therefore, the less metal catalyst content in the superabrasive compact, such as diamond body, the better thermal stability of the superabrasive compact.

Depletion of catalyst from the polycrystalline diamond body, for example, by chemical leaching in acids, leaves an interconnected network of pores and up to about 10 vol % residual catalyst, trapped inside the polycrystalline diamond body. It has been demonstrated that depletion of cobalt from the polycrystalline diamond body may significantly improve an abrasion resistance of PDC cutter. Thus, a thicker cobalt depleted layer near the cutting edge, such as more than about 100 μm, may provide better abrasion resistance of the PDC cutter than a thinner cobalt depleted layer, such as less than about 100 μm.

Polycrystalline diamond cutting elements may be fabricated in different ways and the examples discussed herein do not limit a variety of different types of diamond composites and PDC cutters, which may be produced according to an embodiment. In one particular example, polycrystalline cutting element may be formed by placing a mixture of diamond powder with a suitable solvent catalyst material (e.g. cobalt powder) on the top of WC—Co substrate, the assembly is then subjected to conditions of HPHT process, where the solvent catalyst promotes desired inter-crystalline diamond-to-diamond bonding resulted in the formation of a rigid polycrystalline diamond body and, also, provides a binding between polycrystalline diamond body and WC—Co substrate.

In another particular example, a polycrystalline diamond cutting element is formed by placing diamond powder without a catalyst material on the top of a substrate containing a catalyst material (e.g. WC—Co substrate). In this example, necessary cobalt catalyst material is supplied from the substrate and melted cobalt is swept through the diamond powder during the HPHT process. In still another example, a hard polycrystalline diamond composite is fabricated by forming a mixture of diamond powder with silicon powder and the mixture is subjected to an HPHT process, thus forming a dense polycrystalline compact where diamond particles are bound together by newly formed silicon carbide material.

A superabrasive compact or cutting element (or cutter) 10 in accordance with an embodiment is shown in FIG. 1. One example of the superabrasive cutter 10 may include a superabrasive body 12 having a top surface 21.

In one embodiment, the superabrasive compact 10 may be a standalone compact without a substrate. In another embodiment, the superabrasive compact 10 may include a substrate 20 attached to the superabrasive body 12. In one embodiment, the superabrasive body 12 may be formed by superabrasive particles, such as polycrystalline diamond particles. Superabrasive body 12 may be referred as a diamond body 12. The substrate 20 may be metal carbide, attached to the diamond body 12. Substrate 20 may be made from cemented cobalt tungsten carbide, while the diamond body 12 may be made from a polycrystalline diamond or diamond crystals bonded together by diamond-to-diamond bonds or by a foreign material. Superabrasive cutter 10 may be inserted into a down hole as a suitable tool, such as a drill bit, for example.

The superabrasive cutter 10 may be referred to as a polycrystalline diamond compact or cutter when polycrystalline diamond is used to form the diamond body 12. Cutters are known for their toughness and durability, which allow them to be an effective cutter in demanding applications. Although one type of superabrasive cutter 10 has been described, other types of superabrasive cutters 10 may be utilized. For example, in one embodiment, superabrasive cutter 10 may have a chamfer (not shown) around an outer peripheral of the top surface 21. The chamfer may have a vertical height of about 0.5 mm or 1 mm and an angle of about 45° degrees, for example, which may provide a particularly strong and fracture resistant tool component. The superabrasive cutter 10 may be a subject of procedure depleting catalyst metal (e.g. cobalt) near the cutting surface of the compact, for example, by chemical leaching of cobalt in acidic solutions. The unleached superabrasive cutter may be fabricated according to processes known to persons having ordinary skill in the art. Methods for making diamond compacts and composite compacts are more fully described in U.S. Pat. Nos. 3,141,746; 3,745,623; 3,609,818; 3,850,591; 4,394,170; 4,403,015; 4,794,326; and 4,954,139.

Figure 2:
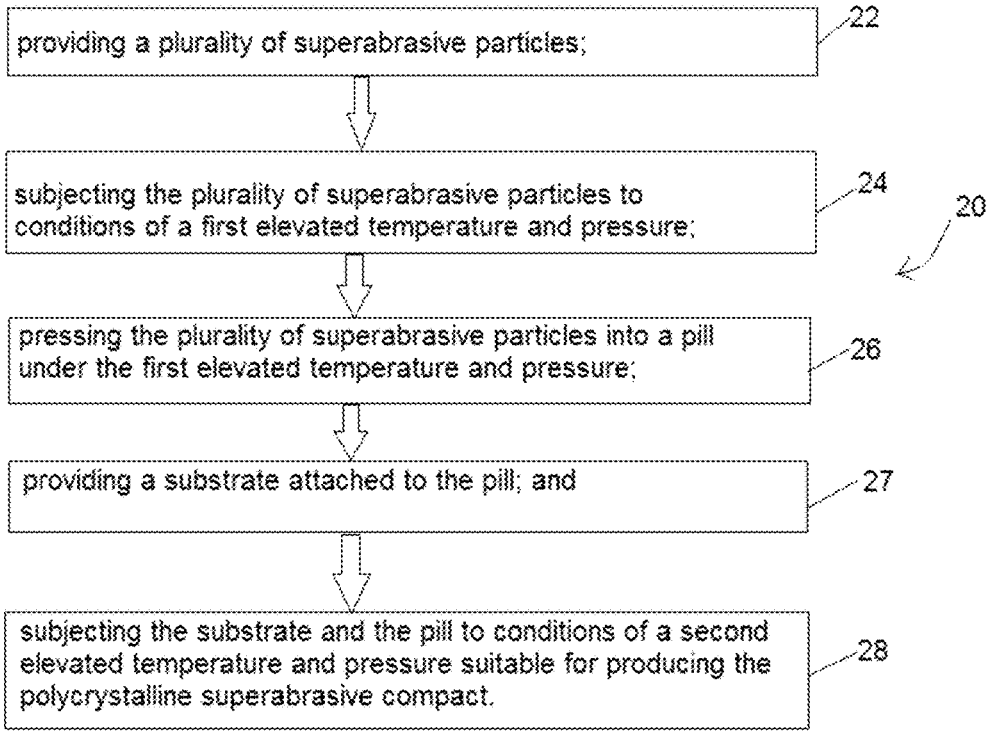
FIG. 2 is a flow chart illustrating a method of making a superabrasive compact according to one embodiment.

As shown FIG. 2, a method of making a superabrasive compact may include steps providing a plurality of superabrasive particles, such as cubic boron nitride, diamond, and diamond composite materials, in a step 22; subjecting the plurality of superabrasive particles to conditions of a first elevated temperature and pressure in a step 24;

pressing the plurality of superabrasive particles into a pill under the first elevated temperature and pressure in a step 26; providing a substrate attached to the pill in a step 27; and subjecting the substrate and the pill to conditions of a second elevated temperature and pressure suitable for producing the superabrasive compact, such as polycrystalline diamond compact, in a step 28.

In one embodiment, the first elevated temperature may be higher than the second elevated temperature. The first elevated temperature may be more than about 1600° C. During the first elevated temperature and pressure, the superabrasive particles do not have a catalyst present. The second elevated temperature may be from about 1400° C. to about 1550° C. In another embodiment, the first elevated temperature may be more than about 2000° C.

Initially, the superabrasive particles, such as diamond powder, may be loaded in a refractory metal can and pressed without any catalyst material at high pressures and significantly high temperatures more than 1600° C. while diamond powder still stays within the diamond stable region. In the presence of catalyst, the diamond powder may be back converted to graphite at a lower temperature. So a catalyst material may be avoided at this stage. The diamond crystals may be plastically deformed and the density of the packed diamond bed may be higher than that made at lower temperatures. The packed bed or the pill may then be infiltrated with catalyst material from a suitable source, such as from cemented tungsten carbide, at the second elevated temperature and pressure, such as conventional temperature and pressure conditions, to give a denser compact which is expected to have a higher abrasion resistance and higher thermal stability (due to lower metal content in the PCD) than conventionally sintered PCD. Because metal catalyst has a much higher coefficient of thermal expansion (CTE) than superabrasive particles, such as polycrystalline diamonds, polycrystalline cubic boron nitrides, or diamond composite, the sintered superabrasive body with more metal catalyst may not be as thermally stable as the sintered superabrasive body with less metal catalyst. The method 20 may further comprise crushing the plurality of superabrasive particles during the first elevated high pressure and high temperature.

One or more steps may be inserted in between or substituted for each of the foregoing steps 22-28 without departing from the scope of this disclosure.

Figure 3:
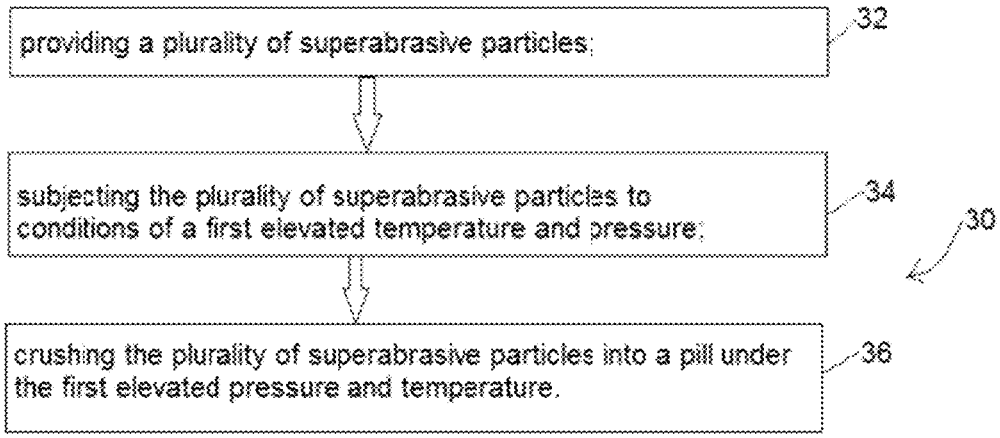
FIG. 3 is a flow chart illustrating a method of making a superabrasive compact according to another embodiment.

As shown in FIG. 3, a method 30 of making a superabrasive compact may comprise steps of providing a plurality of superabrasive particles, being selected from a group consisting of cubic boron nitride, diamond, and diamond composite materials, in a step 32; subjecting the plurality of superabrasive particles to conditions of a first elevated temperature and pressure in a step 34; and crushing the plurality of superabrasive particles into a pill under the first elevated pressure and temperature, wherein the plurality of superabrasive particles do not have a catalyst present during the first elevated temperature and pressure, in a step 36. The method 30 may further comprise steps of providing a substrate attached to the pill; subjecting the substrate and the pill to conditions of a second elevated temperature and pressure suitable for producing the superabrasive compact.

During the first elevated pressure and temperature, some surface carbons on the diamond may be back converted to graphite even without catalyst present. So after the first elevated pressure and temperature, acid and water may be used to remove graphite. During the first elevated temperature and pressure, such as more than about 1600° C. and from about 55 kbar to about 75 kbar, the diamond crystals may be plastically deformed and the density of the packed diamond bed may be higher than that made at lower temperatures.

Diamond compacts and composite compacts may be made various ways. In one embodiment, a superabrasive compact may be prepared by a process, where the process may comprise steps of: providing a plurality of superabrasive particles, wherein the plurality of superabrasive particles do not have a catalyst present during the first elevated temperature and pressure; subjecting the plurality of superabrasive particles to conditions of a first elevated temperature and pressure; and crushing the plurality of superabrasive particles into a pill under the first elevated high pressure and high temperature. The method may further comprise steps of providing a substrate, such as a cemented tungsten carbide substrate, attached to the pill; subjecting the substrate and the pill to conditions of a second elevated temperature and pressure suitable for producing the superabrasive compact; and sweeping the plurality of superabrasive particles with a catalyst from the substrate.

When sintering superabrasive particles, such as diamond crystals of different sizes to form polycrystalline diamond, the thermodynamic driving force may be essentially a reduction in surface energy of the mixture. This may be achieved through crushing diamond crystals into smaller pieces and dissolving carbon atoms at the high energy points of contact between diamond grains under high pressure followed by precipitation at lower energy sites. This may also be achieved through dissolution of small particles of diamond which have higher surface energy per unit volume than the larger crystals, and then precipitating carbon in the form of diamond on the larger crystals. Small particles may continue to dissolve and their carbon atoms migrate toward larger grains since the chemical potential of carbon atoms on a diamond grain is a function of the radius of the grain. The smaller the radius, the larger the chemical potential of surface carbon atoms on that grain.

Conversely, a larger grain having a flat surface may have minimum chemical potential of carbon atoms since the radius is infinity. Concentration of carbon atoms onto larger crystals from smaller particles reduces the total energy of the system towards a minimum. Under an HPHT process, a particle size distribution starting with higher packing density may in turn result in lower metal catalyst content compared to a starting distribution which does not have a higher packing density.

EXAMPLE 1

About 22 micron diamond powders were disposed inside a refractory metal container and compacted at about 62 Kbar and 2000° C. in a HPHT press. After pressing, the refractory metal was removed by grinding and a compacted diamond pill was obtained. This pill was then cleaned in acid, such as hydrochloric acid and water and then sintered at about 75 kbar, 1550° C. with a substrate containing a source of cobalt (this cutter would be called pre-compacted cutter in subsequent text). Alternatively, the cleaning the pill step by the acid was not necessary since the graphite will be converted to diamond during the second HPHT pressing. In addition, graphite on the surface of the diamond particles may act as a lubricant for further densification of the pill during the second pressing which may result in lower metal content in the polycrystalline diamond compact. A baseline cutter was also made by disposing the 22 micron diamond feed and a cobalt containing substrate inside a refractory metal container and sintering at about 75 Kbar,1550° C. (without any intermediate high pressure, high temperature densification step).

The cutters were then finished by regular finishing operations, such as grinding and lapping. During lapping, the elemental composition of the diamond table was measured by XRF at different diamond layer thicknesses. As shown in Table 1, pre-compacted cutter at 2.5 mm diamond table had 91.4 wt % diamond or carbon and 6.899 wt % cobalt. The baseline cutter at 2.5 mm diamond table thickness may have 90 wt % diamond or carbon and 7.820 wt % cobalt. As shown in Table 2, a pre-compacted cutter at 1.8 mm diamond table thickness had 90.7 wt % diamond and 7.224% Co. In contrast, a baseline cutter at 1.8 mm diamond table thickness had 90.1 wt % diamond and 7.662 wt % cobalt. The XRF measurements showed that the pre-compacted cutter had a higher diamond weight percentage than the baseline cutter.

TABLE 1

| | wt % C | wt % Co | w % Cr | wt % W |
|---|---|---|---|---|
| Pre-compacted cutter at 2.5 mm diamond table thickness | 91.4 | 6.899 | 0.291 | 1.380 |
| Baseline cutter at 2.5 mm diamond table thickness | 90 | 7.820 | 0.386 | 1.760 |

TABLE 2

| | wt % C | wt % Co | wt % Cr | wt % W |
|---|---|---|---|---|
| Pre-compacted cutter at 1.8 mm diamond table thickness | 90.7 | 7.224 | 0.352 | 1.710 |
| Baseline cutter at 1.8 mm diamond table thickness | 90.1 | 7.662 | 0.368 | 1.833 |

Both cutters were then tested on a Vertical turret lathe (VTL) test for abrasion resistance. A bevel of 45 degrees× 0.016" was ground onto the cutting edge of the cutters. The cutters were tested on a vertical turret lathe (VTL) in testing methodology. Specifically, the cutter was tested such that the depth of cut was between 0.015" and 0.019" under a continuous flood of cooling fluid. The table was rotated at a variable speed such that the cutter machined a constant amount at 400 linear feet per minute. The cutter was in-fed into the rock at a constant rate of 0.160" per revolution of the table. The cutter was mounted into a fixture at an incline rake angle of −15 degrees and a side rake angle of zero degrees. The rock used in the test was a member of the granite family of rocks. The pre-compacted cutter and baseline cutters were processed under identical conditions of cutter preparation, and dimensional finishing. The amount of rock removed in each test was kept constant, and the amount of cutter wear was determined by microscopic examination and volumetric calculation. The final states of cutter wear for both treated and untreated conditions were plotted in FIG. 4.

Figure 4:
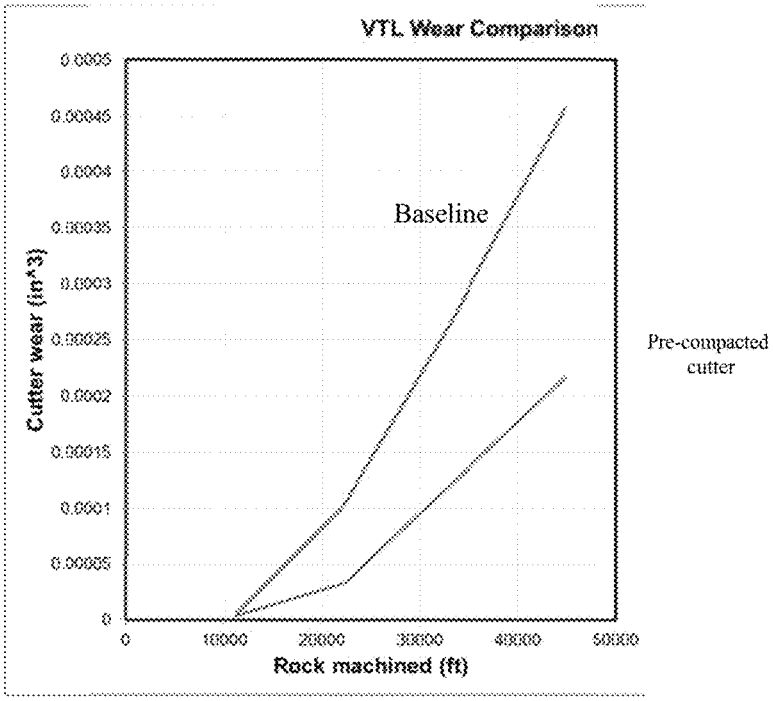
FIG. 4 is a graph illustrating vertical turret lathe (VTL) test results of a pre-compacted cutter and a baseline cutter according to one embodiment.

FIG. 4 shows the results of VTL testing for the two cutters. The amount of cutter wear for the pre-compacted cutter was about half the cutter wear for the baseline cutter. As shown in FIG. 4, the pre-compacted cutter was clearly better than the baseline cutter in the test.

Lists of itemized embodiments:

1. A method of making a superabrasive compact, comprising:
   providing a plurality of superabrasive particles;
   subjecting the plurality of superabrasive particles to conditions of a first elevated temperature and pressure;
   pressing the plurality of superabrasive particles into a pill under the first elevated temperature and pressure;
   providing a substrate attached to the pill; and
   subjecting the substrate and the pill to conditions of a second elevated temperature and pressure suitable for producing the superabrasive compact.
2. The method of item 1, wherein the first elevated temperature is higher than the second elevated temperature.
3. The method of item 1, wherein the first elevated temperature is more than 1600° C.
4. The method of item 1, wherein the second elevated temperature is from 1400° C. to 1550° C.
5. The method of item 1, wherein the plurality of superabrasive particles do not have a catalyst present during the first elevated temperature and pressure.
6. The method of item 1, wherein the substrate is a cemented tungsten carbide.
7. The method of item 1, wherein the superabrasive particles are selected from a group consisting of cubic boron nitride, diamond, and diamond composite materials.
8. The method of item 1, further comprising crushing the plurality of superabrasive particles during the first elevated high pressure and high temperature.
9. A method of making a superabrasive compact, comprising:
   providing a plurality of superabrasive particles;
   subjecting the plurality of superabrasive particles to conditions of a first elevated temperature and pressure; and
   crushing the plurality of superabrasive particles into a pill under the first elevated pressure and temperature.
10. The method of item 9, wherein the superabrasive particles are selected from a group consisting of cubic boron nitride, diamond, and diamond composite materials.
11. The method of item 9, further comprising providing a substrate attached to the pill.
12. The method of item 11, wherein the substrate is a cemented tungsten carbide substrate.
13. The method of item 11, further comprising subjecting the substrate and the pill to conditions of a second elevated temperature and pressure suitable for producing the superabrasive compact.
14. The method of item 13, wherein the first elevated temperature is higher than the second elevated temperature.
15. The method of item 9, wherein the first elevated temperature is more than 1600° C.
16. The method of item 13, wherein the second elevated temperature is from 1400° C. to 1550° C.
17. The method of item 9, wherein the plurality of superabrasive particles do not have a catalyst present during the first elevated temperature and pressure.
18. A superabrasive compact prepared by a process comprising steps of:
    providing a plurality of superabrasive particles, wherein the plurality of superabrasive particles do not have a catalyst present during the first elevated temperature and pressure;
    subjecting the plurality of superabrasive particles to a first elevated temperature and pressure; and
    crushing the plurality of superabrasive particles into a pill under the first elevated high pressure and high temperature.

19. The superabrasive compact of the process of item 18, further comprising providing a substrate attached to the pill.
20. The superabrasive compact of the process of item 19, wherein the substrate is a cemented tungsten carbide substrate.
21. The superabrasive compact of the process of item 18, wherein the superabrasive particles are selected from a group consisting cubic boron nitride, diamond, and diamond composite materials.
22. The superabrasive compact of the process of item 19, further comprising subjecting the substrate and the pill to conditions of a second elevated temperature and pressure suitable for producing the superabrasive compact.
23. The superabrasive compact of the process of item 18, wherein the first elevated temperature is more than 1600° C.
24. The superabrasive compact of the process of item 18, wherein the second elevated temperature is from 1400° C. to 1550° C.
25. The superabrasive compact of the process of item 19, further comprising sweeping the plurality of superabrasive particles with a catalyst from the substrate.

While the reference has been made to specific embodiments, it is apparent that other embodiments and variations can be devised by others skilled in the art without departing from their spirit and scope of this disclosure. The appended claims are intended to be construed to include all such embodiments and equivalent variations.

What is claimed is:

1. A method of making a superabrasive compact, comprising: providing a plurality of superabrasive particles;
subjecting the plurality of superabrasive particles to a first elevated temperature and pressure;
pressing the plurality of superabrasive particles into a pill under the first elevated temperature and pressure;
providing a substrate attached to the pill; and
subjecting the substrate and the pill to a second elevated temperature and pressure suitable for producing the superabrasive compact wherein the first elevated temperature is higher than the second elevated temperature.

2. A method of making a superabrasive compact, comprising:
providing a plurality of superabrasive particles;
subjecting the plurality of superabrasive particles to a first elevated temperature and pressure;
pressing the plurality of superabrasive particles into a pill under the first elevated temperature and pressure;
providing a substrate attached to the pill; and
subjecting the substrate and the pill to a second elevated temperature and pressure suitable for producing the superabrasive compact, wherein the first elevated temperature is more than about 1600° C.

3. The method of claim 1, wherein the second elevated temperature is from about 1400° C. to about 1550° C.

4. The method of claim 1, wherein the plurality of superabrasive particles do not have a catalyst present during the first elevated temperature and pressure.

5. The method of claim 1, wherein the substrate is a cemented tungsten carbide.

6. The method of claim 1, wherein the superabrasive particles are selected from a group consisting of cubic boron nitride, diamond, and diamond composite materials.

7. The method of claim 1, further comprising crushing the plurality of superabrasive particles during the first elevated high pressure and high temperature.

8. A method of making a superabrasive compact, comprising: providing a plurality of superabrasive particles;
subjecting the plurality of superabrasive particles to a first elevated temperature and pressure; and
crushing the plurality of superabrasive particles into a pill under the first elevated pressure and temperature, wherein the first elevated temperature is more than about 1600° C.

9. The method of claim 8, wherein the superabrasive particles are selected from a group consisting of cubic boron nitride, diamond, and diamond composite materials.

10. The method of claim 8, further comprising providing a substrate attached to the pill.

11. The method of claim 10, wherein the substrate is a cemented tungsten carbide substrate.

12. The method of claim 10, further comprising subjecting the substrate and the pill to a second elevated temperature and pressure suitable for producing the superabrasive compact.

13. The method of claim 12, wherein the first elevated temperature is higher than the second elevated temperature.

14. The method of claim 12, wherein the second elevated temperature is from about 1400° C. to about 1550° C.

15. The method of claim 8, wherein the plurality of superabrasive particles do not have a catalyst present during the first elevated temperature and pressure.

16. A superabrasive compact prepared by a process comprising steps of: providing a plurality of superabrasive particles;
subjecting the plurality of superabrasive particles to conditions of a first elevated temperature and pressure, wherein the plurality of superabrasive particles do not have a catalyst present during the first elevated temperature and pressure; and
crushing the plurality of superabrasive particles into a pill under the first elevated high pressure and high temperature, wherein a substrate attached to the pill, and wherein the substrate and the pill are subjected to a second elevated temperature and pressure suitable for producing the superabrasive compact, wherein the first elevated temperature is higher than the second elevated temperature.

17. The superabrasive compact of the process of claim 16, wherein the substrate is a cemented tungsten carbide substrate.

18. The superabrasive compact of the process of claim 16, wherein the superabrasive particles are selected from a group consisting cubic boron nitride, diamond, and diamond composite materials.

19. The superabrasive compact of the process of claim 16, wherein the first elevated temperature is more than about 1600° C.

20. The superabrasive compact of the process of claim 16, wherein the second elevated temperature is from about 1400° C. to about 1550° C.

21. The superabrasive compact of the process of claim 16, further comprising sweeping the plurality of superabrasive particles with a catalyst from the substrate.

22. The method of claim 2, wherein the second elevated temperature is from about 1400° C. to about 1550° C.

23. The method of claim 2, wherein the plurality of superabrasive particles do not have a catalyst present during the first elevated temperature and pressure.

24. The method of claim 2, wherein the substrate is a cemented tungsten carbide.

25. The method of claim 2, wherein the superabrasive particles are selected from a group consisting of cubic boron nitride, diamond, and diamond composite materials.

26. The method of claim 2, further comprising crushing the plurality of superabrasive particles during the first elevated high pressure and high temperature.

* * * * *